US008544177B2

(12) United States Patent
Rawle et al.

(10) Patent No.: US 8,544,177 B2
(45) **Date of Patent: *Oct. 1, 2013**

(54) RAZOR WITH REARWARDLY SECURED SHAVING BLADE MEMBER

(75) Inventors: Stephen Leonard Rawle, Newbury (GB); Russell Stuart Avens, Banbury (GB)

(73) Assignee: The Gillette Company, Boston, MA (US)

( * ) Notice: Subject to any disclaimer, the term of this patent is extended or adjusted under 35 U.S.C. 154(b) by 661 days.

This patent is subject to a terminal disclaimer.

(21) Appl. No.: 12/260,455

(22) Filed: Oct. 29, 2008

(65) Prior Publication Data

US 2009/0113717 A1 May 7, 2009

Related U.S. Application Data

(60) Provisional application No. 61/001,679, filed on Nov. 2, 2007.

(51) Int. Cl.
*B26B 21/00* (2006.01)

(52) U.S. Cl.
USPC ..... 30/50; 30/52; 30/58; 30/59

(58) Field of Classification Search
USPC ..... 30/50, 52, 41, 51, 58, 59, 57, 527, 30/47
See application file for complete search history.

(56) References Cited

U.S. PATENT DOCUMENTS 3,816,913 A 6/1974 Ferraro
4,168,571 A * 9/1979 Francis ..... 30/47
4,200,976 A * 5/1980 Gooding ..... 30/47
4,227,302 A 10/1980 Torrance
4,253,236 A 3/1981 Jacobson
4,754,548 A * 7/1988 Solow ..... 30/50
5,104,605 A 4/1992 Butlin et al.
5,182,858 A 2/1993 Chen
5,236,439 A 8/1993 Kosikowski
5,253,420 A * 10/1993 Althaus et al. ..... 30/50
5,388,332 A 2/1995 Olroyd
5,822,862 A 10/1998 Ferraro
5,953,825 A * 9/1999 Christman et al. ..... 30/527
6,035,535 A * 3/2000 Dischler ..... 30/48
6,115,924 A 9/2000 Olroyd
6,173,498 B1 1/2001 Warrick et al.
6,430,814 B1 * 8/2002 Solow ..... 30/47
6,671,961 B1 * 1/2004 Santhagens Van Eibergen et al. ..... 30/50
6,877,227 B2 * 4/2005 Santhagens Van Eibergen et al. ..... 30/50
7,024,776 B2 4/2006 Wain
7,047,646 B2 5/2006 Coffin
7,100,284 B2 * 9/2006 King ..... 30/49

(Continued)

*Primary Examiner* — Omar Flores Sanchez
(74) *Attorney, Agent, or Firm* — Kevin C. Johnson; Steven W. Miller

(57) ABSTRACT

A shaving blade unit comprising a shaving cartridge having a rearwardly secured shaving blade member wherein the cartridge comprises a) a housing having a front wall, a rear wall, and opposing side walls extending between the front and rear walls; b) a shaving blade member disposed within said walls of the housing and wherein the blade member has a cutting edge that faces a front surface of said housing; c) a resilient member disposed rearward of the shaving blade member and that is secured by a shaving blade member retainer; and wherein the resilient member provides a forward biasing force to the shaving blade member and wherein the shaving blade member exhibits a springing motion during a shaving stroke.

18 Claims, 6 Drawing Sheets

(56) References Cited

U.S. PATENT DOCUMENTS

| | | | | |
|---|---|---|---|---|
| 7,200,938 | B2 | 4/2007 | Lembke | |
| 7,703,361 | B2 * | 4/2010 | Johnson et al. | 83/13 |
| 8,234,789 | B2 * | 8/2012 | Avens et al. | 30/50 |
| 2002/0023352 | A1 | 2/2002 | Mil'shtein | |
| 2003/0208907 | A1 | 11/2003 | Brown et al. | |
| 2005/0015991 | A1 | 1/2005 | Follo et al. | |
| 2006/0218794 | A1 | 10/2006 | Bunnell et al. | |
| 2007/0056167 | A1 | 3/2007 | Richard et al. | |

* cited by examiner

RAZOR WITH REARWARDLY SECURED SHAVING BLADE MEMBER

CROSS REFERENCE TO RELATED APPLICATION

This application claims the benefit of U.S. Provisional Application No. 61/001,679 filed Nov. 2, 2007.

FIELD OF THE INVENTION

The present invention relates to a razor suitable for wet shaving wherein the razor comprises a cartridge that includes a rearwardly secured shaving blade member for provision of a conforming shave.

BACKGROUND OF THE INVENTION

In the past few years, there has been an increase in the number of blades that are incorporated into wet shaving razors. This increase has been seen in an attempt to provide users with a closer shave while increased guard area has also burgeoned to provide increased shaving comfort. Despite this advantage of increased comfort, it is accompanied with a slight disadvantage of making it more difficult for a user to see the skin surface that is being shaved. Thus, this inability to see the shaving area makes a more precise shave more difficult to achieve. Furthermore, a large portion of marketed razors have and do still contain clips at the respective longitudinal ends of the cartridge to secure the shaving blades to the cartridge housing. Users, however, perceive that these clips also contribute to a less precise shave as they block the view of certain portions of skin surface to be shaved. The clips of commercially available razors, however, serve an important purpose of keeping the shaving blades secured to the razor cartridge.

Clearly, there is a need to provide a shaving product to consumers that allows for an improved view of the surface to be shaved so that there is little to no apprehension about safety or the preciseness of the resulting shave due to a blocked view. There remains an additional need to heighten the efficiency of the contact area of the razor's shaving surface and the skin surface such that as much contact area as possible equates to area where hair is being shaved.

SUMMARY OF THE INVENTION

The present invention relates to a shaving blade unit comprising a shaving cartridge having a rearwardly secured shaving blade member wherein said cartridge comprises:

a. a housing having a front wall, a rear wall, and opposing side walls extending between said front and rear walls;
b. a shaving blade member disposed within said walls of said housing wherein said blade member has a cutting edge that faces a front surface of said housing;
c. a resilient member disposed rearward of said shaving blade member and that is secured by a shaving blade member retainer; and wherein said resilient member provides a forward biasing force to said shaving blade member and wherein said shaving blade member exhibits a springing motion during a shaving stroke.

DETAILED DESCRIPTION OF THE INVENTION

Figure 1:
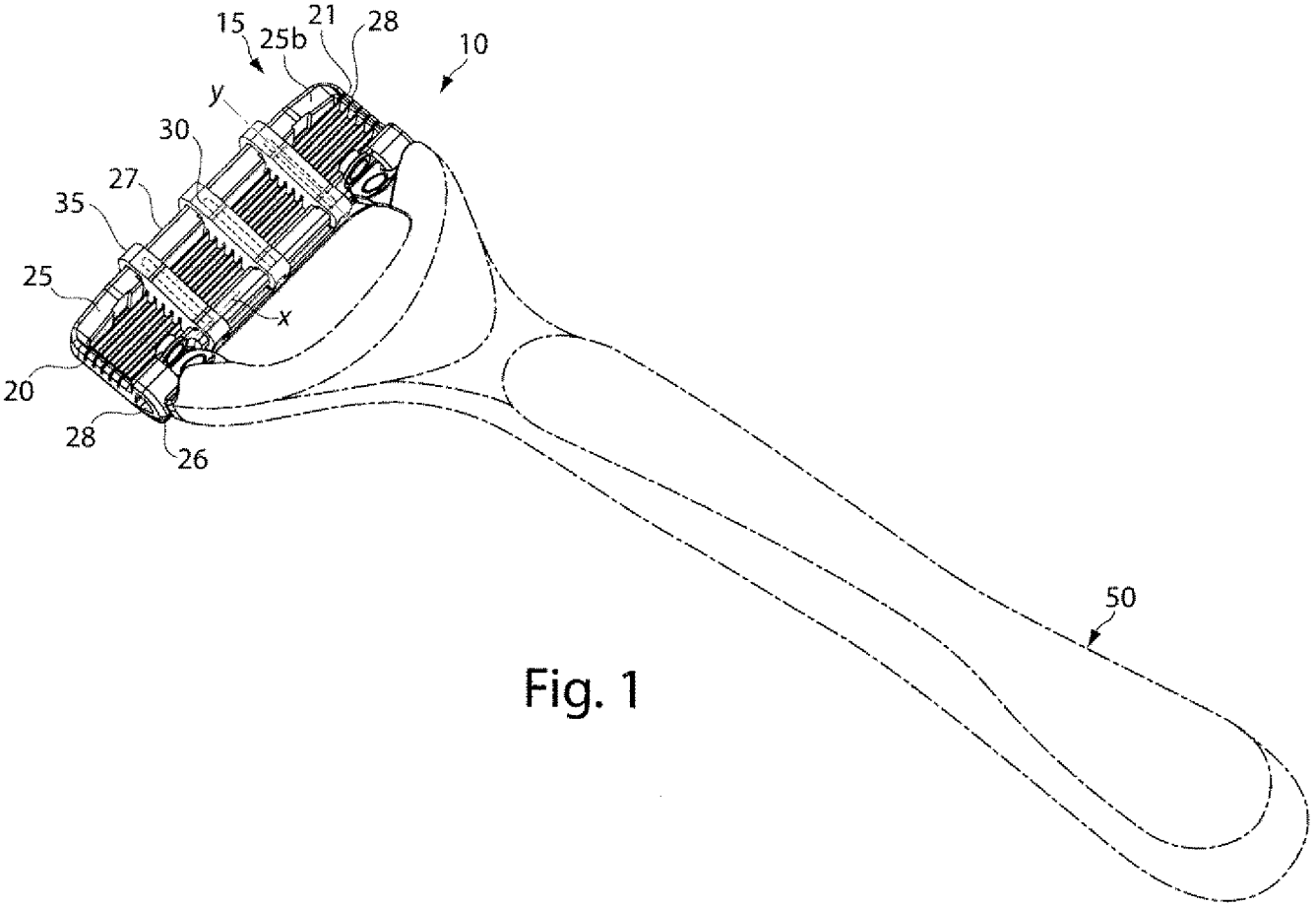
FIG. 1 is a bottom perspective view of a shaving blade unit of the present invention.
Figure 2:
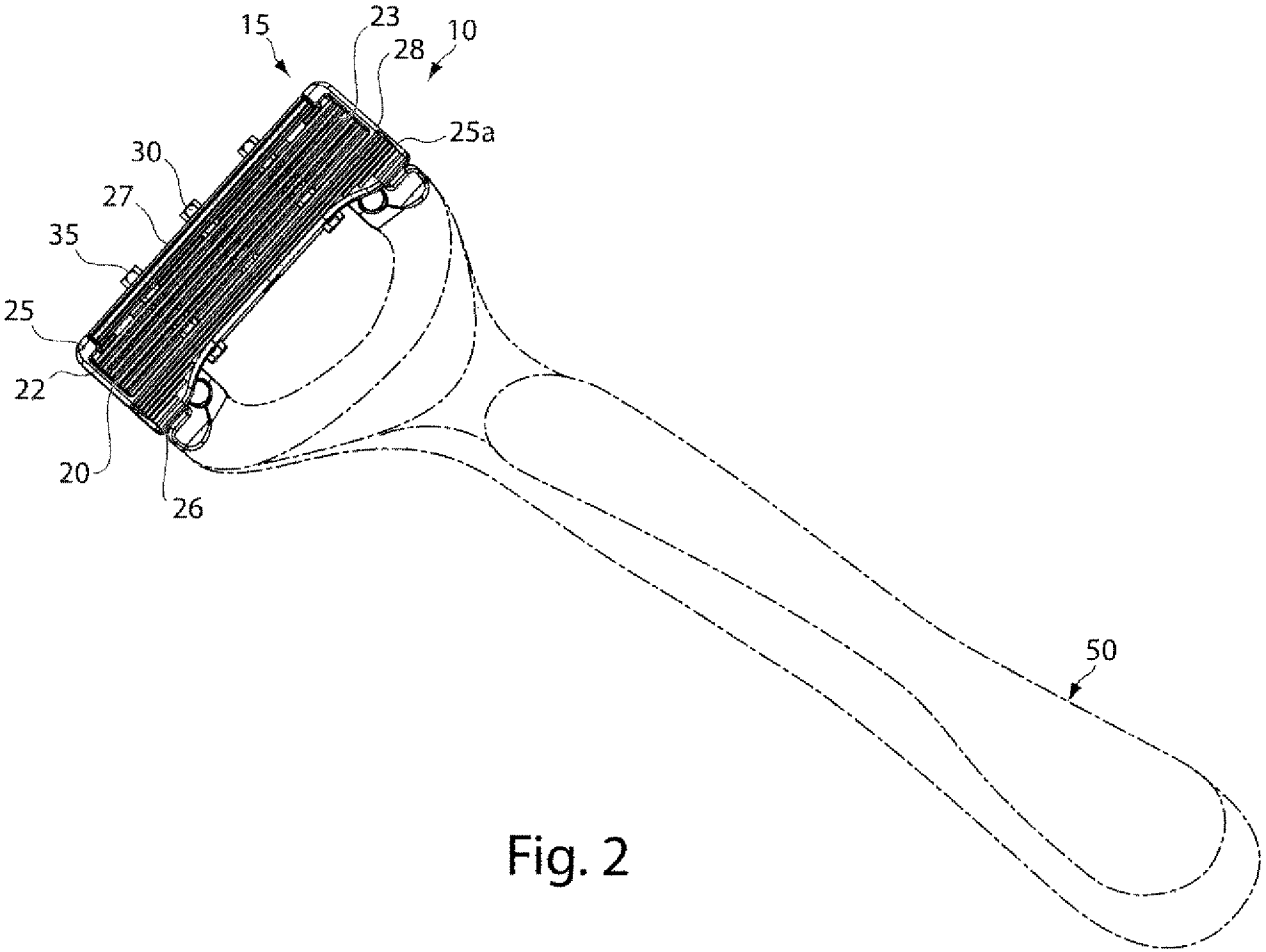
FIG. 2 is a top perspective view of the unit of FIG. 1.

The present invention is related to a shaving blade unit as shown in FIGS. 1 and 2. In FIGS. 1 and 2, the shaving blade unit 10 comprises a shaving cartridge 15 having a rearwardly secured shaving blade member 20 while the cartridge 15 comprises a housing 25 having a front wall 26, a rear wall 27, and opposing side walls 28 extending between said front and rear walls 26, 27. The cutting edge 23 of the shaving blade member 20 is facing a front surface 25*a* of the housing 25. The cartridge 15 additionally includes a resilient member 30 that is disposed rearward of the shaving blade member 20. This resilient member 30 is secured to a rear surface 25*b* of the housing 25 by a shaving blade member retainer 35.

The housing 25 serves as a carrier for the shaving blade member 20 within the unit 10 and may be formed from injection molded plastics. Suitable materials include, but are not limited to, Xylex® resin (a transparent blend of polycarbonate and an amorphous polyester available from SABIC Innovative Plastics), Zylar® (a water clear styrene methylmethacrylate copolymer that has been modified for impact which is available from NOVA Chemicals), and Noryl® (which is a class modified PPE resins consists of amorphous blends of PPO polyphenylene ether resin and polystyrene available from SABIC Innovative Plastics). The shaving blade member retainer 35 may be formed from the same materials as the housing 25. The retainer 35 may additionally be formed separately from the housing 25 and attached thereto or it may be integrally formed with the housing 25 via extrusion molding etc.

The retainer 35 secures the resilient member 30 to the rear of the shaving blade member 20. As a result of being secured by the retainer 35, the resilient member 30 exhibits a relatively stationary surface upon which the shaving blade member 20 may exert force against during shaving use and times of non-use by a consumer. This biasing force serves to provide shaving blade members that are able to conform to the surface of the skin more readily but with the appropriate amount of give that allows for a comfortable shave. Ideally, the forward biasing force is significant enough that the shaving blade member exhibits a springing motion during a shaving stroke.

Figure 5:
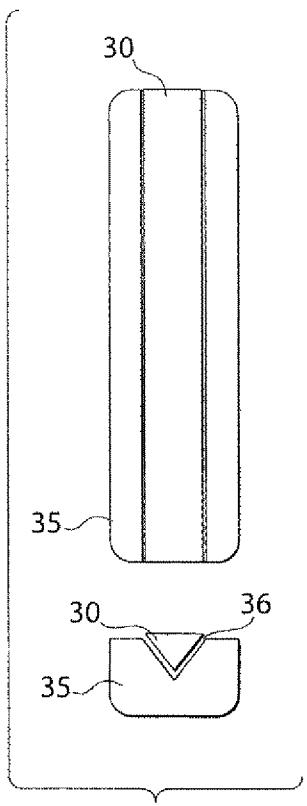
FIG. 3-5 show top plan views of various retainer and resilient member configurations of the presently claimed razor blade units paired with their respective cross-sectional views.
Figure 4:
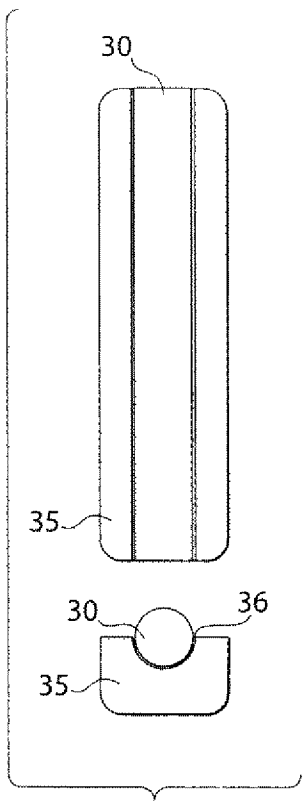
Figure 3:
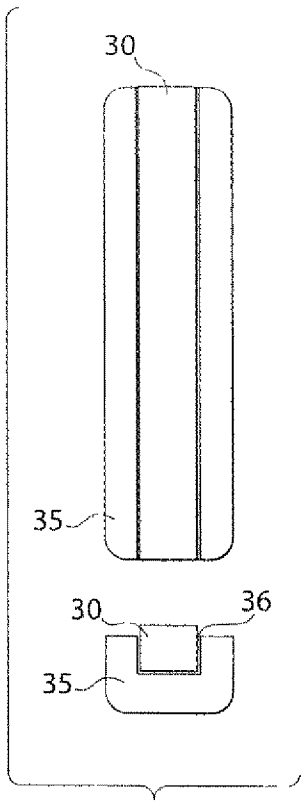

In certain embodiments, the retainer 35 comprises a channel 36 in which the resilient member 30 may rest. The channel 36 further secures the resilient member 30 within the cartridge 15. The cross-sectional shape of the channel 36 may take any number of forms, e.g., semicircular, rectangular, slitted, triangular, etc., depending on whatever is most suitable given the shape of the resilient member 30. FIG. 4 shows cross section at x of FIG. 1 wherein the resilient member is round. FIGS. 3 and 5 show a cross section at x in a shaving blade unit of the present invention where the resilient member and mating channel comprise a rectangular and triangular cross sections, respectively. As shown, the resilient member 30 may have a cross-sectional shape of any type so long as it is a shape that mates with the channel's shape (when channel 36 is present) to provide a snug configuration of the two components. Furthermore, rear portions of the shaving blade members 20 contact the resilient member 30 to provide the biasing force.

Figure 6:
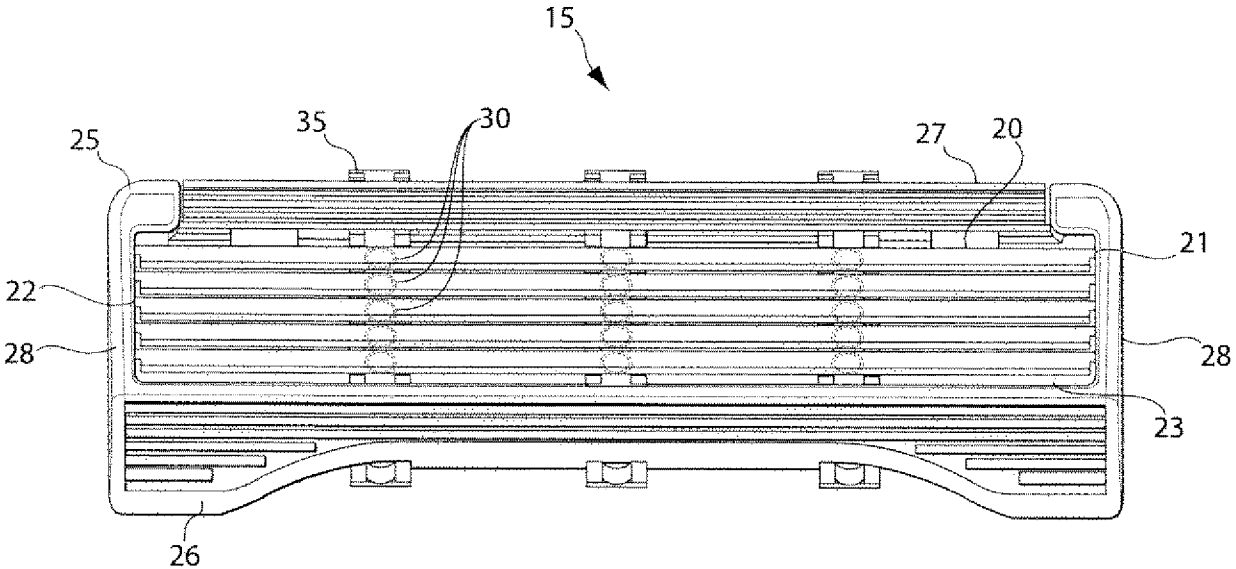
FIG. 6 is a top plan view of another cartridge of the shaving blade unit of the present invention where resilient members are round and individually placed against a rearward portion of each shaving blade member.
Figure 7A:
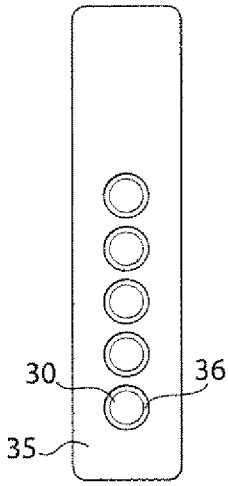
FIGS. 7*a* and 7*b* are a top plan view and a cross-sectional view of one of the retainers shown in FIG. 6.
Figure 7B:
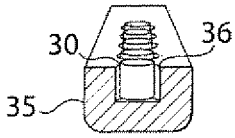

The resilient member 30 may be formed of a number of different materials to provide the relatively responsive return that is characteristic of this component. For instance, the resilient member 30 is selected from the group consisting of solid or hollow elastomeric tubing, solid or hollow rubber tubing, foam forms, coils, spring fingers, and combinations thereof. In particular, the resilient member 30 may comprise a single component that is paired with its respective retainer 35 where the resilient member 30 runs along the length of the retainer 35 or substantially the entire length of the retainer 35. Alternatively, the resilient member 30 may occur in a plurality with a single retainer 35 such that a single member is disposed rearward of each shaving blade member 20 where there is also a plurality of shaving blade members 20 within a unit 10. For instance, where there are a plurality of shaving blade members (e.g., five as shown in FIG. 6) disposed in a parallel configuration within a cartridge 15 and there are correspondingly three retainers 35 to provide support for the shaving blade members 20, there may be a section of solid or hollow elastomeric tubing that is placed with one of its round ends (serving as a resilient member 30) contacting the retainer 35 or the channel 36 of the retainer 35 while an opposing end of the tubing portion is contacting a rear portion of the shaving blade member 20. Similarly, a second tubing portion would be disposed further down the length of the same retainer to contact the retainer or channel of the retainer and the rear portion of a second, third, fourth, and fifth parallel shaving blade members that line up with the corresponding portion of the first shaving blade member. FIGS. 7*a* and 7*b* show a single retainer of the unit of FIG. 6 without the shaving blade members along with a cross section of the same retainer.

Figure 8:
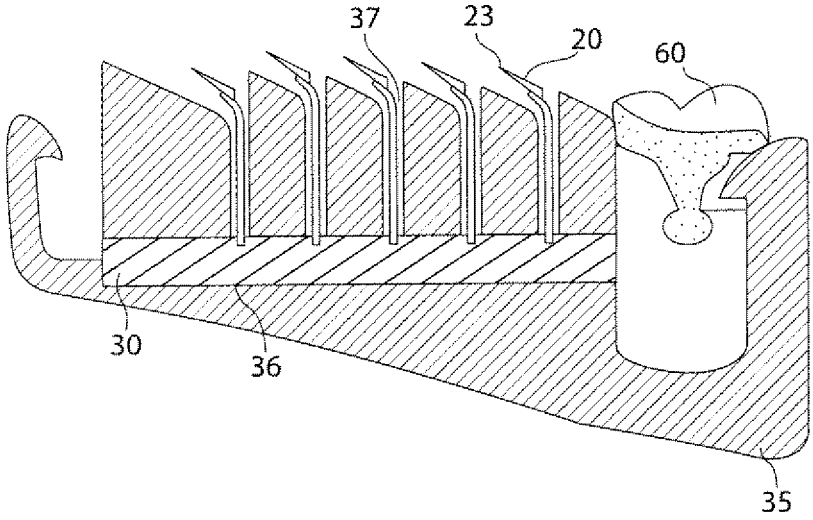
FIG. 8 shows a side cross-sectional view of one of the retainers of FIGS. 1 and 2.

It is desirable for the retainer 35 to comprise a recess 37 to receive at least a portion of the shaving blade member 20. The recess 37 may be formed in any shape that easily accommodates the shaving blade member. A plurality of such slitted recesses 37 are shown in FIG. 8, which is a cross section at y of FIG. 1. The recesses 37 are disposed forward of a lubricating strip 60, which is disposed after the shaving blade members 20. Such recesses 37 may be spaced at regular intervals along a length of the retainer 35, where the length runs from the rear wall 27 to the front wall 26 of the housing when the retainer 35 is joined to the housing 25. The recesses 37 may range in width from about 0.15 mm to about 0.25 mm, about 0.16 mm to about 0.23 mm, from about 0.17 mm to about 0.21 mm, from about 0.17 mm to about 0.19 mm, or even about 0.18 mm. Regardless of the recess 37 width, it is important that to the extent there is unoccupied area within the recess 37, steps must be taken to ensure that the shaving blade member 20 does not move in a deleterious manner in the recess 37 when shaving occurs such that cutting of the skin is prevented. There may be a plurality of recesses 37 in a retainer 35 that run along the length of the retainer 35 to accommodate a plurality of shaving blade members 20. There may also be a two or more shaving blade member retainers 35 present along the length of the housing 25. The plurality of retainers 35 disposed along the length of the cartridge tends to provide an heightened balance and support of the shaving blade member(s) contained within the cartridge 15. In FIGS. 1 and 2, there are three retainer(s) 35 disposed along the length of the cartridge 15.

As indicated immediately above, there may be more than one shaving blade member 20 present in the unit 10. For instance, there may be a plurality, e.g., 2, 3, 4, 5, 6, 7, 8, or even more blade members 20 disposed within the unit where their respective cutting edges 21 are placed parallel to one another. Suitable shaving blade members 20 may comprise a shaving blade alone which has been bent or a shaving blade which has been joined to a bent blade support. Such suitable shaving blade members are disclosed in U.S. Pat. No. 6,804,886 and U.S. Ser. Nos. 11/400,989 and 11/401,131. The shaving blade members may also have cutting edges 23 with the same or varying tip radii, the latter of which is disclosed in US Patent Publications 2007/0227008A1, 2007/0227009A1, 2007/0227010A1. In certain embodiments of the present invention, it has been found advantageous and quite possible to decrease the distance between the opposing end 21 of the shaving blade member 20 and its respective adjacent side wall 28. This is made possible due to the no longer existent need to include clips at or immediately adjacent the ends 21 of the shaving blade member(s) to secure the members 20 to the housing. For instance, it is desirable that each opposing end 21 of the shaving blade member 20 is no more than about 5 mm, 4 mm, 3 mm, 2 mm, 1 mm, or even 0.5 mm from the adjacent side wall 28. Therefore, it is envisioned that various embodiments of this invention shall include units that are free of clips disposed at opposing ends 21 of the shaving blade member(s).

In most instances, the unit of the present invention shall be paired with a handle 50 to form a usable razor. The handle 50 may be removably attachable to the cartridge or may be integrally formed with the cartridge. FIGS. 3 and 4 illustrate a removable handle that includes an ejection button 45 which may be depressed to separate the handle 50 from the unit 10. A cartridge hood 40 may also be paired to the cartridge 15 to form the unit 10. Particularly in the instance when a removable handle is implemented the cartridge hood serves as a connection point between the handle 50 and the cartridge 15. It often aids in the maneuverability afforded a shaver when trying to replace the cartridge with a new cartridge when the shaving blade members have been dulled by continued use or unintended damage to the cutting edge 21 of the shaving blade member.

The rearward securing of the shaving blade member 20 within a cartridge 15 that is disclosed herein comprises the steps of providing a housing 25 for a cartridge 15 where the housing 25 comprises a front wall 26, a rear wall 27, and opposing side walls 28 extending between the front and rear walls 26, 27; resting a shaving blade member 20, having opposing ends 21 adjacent to the respective the side wall 28; positioning a resilient member 30 rearward of the shaving blade member 20; securing the resilient member 30 and the shaving blade member 20 with a shaving blade member retainer 35; wherein the resilient member 30 provides a forward biasing force to the shaving blade member 20 such the shaving blade member exhibits a springing motion during a shaving stroke.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving blade unit comprising a shaving cartridge having a rearwardly secured shaving blade member wherein said cartridge comprises:

a. a housing having a front wall, a rear wall, and opposing side walls extending between said front and rear walls;

b. a shaving blade member disposed within said walls of said housing wherein said blade member has a cutting edge that faces a front surface of said housing;

c. a resilient member disposed rearward of said shaving blade member that is secured by a shaving blade retaining member, said shaving blade retaining member being disposed along a width of said housing, said resilient member is recessed within a channel along a length of said retaining member; and wherein said resilient member provides a forward biasing force to said shaving blade member and wherein said shaving blade member exhibits a springing motion during a shaving stroke.

2. The shaving blade unit of claim 1 wherein said retaining member comprises one or more recesses for receiving at least a portion of said shaving blade member.

3. The shaving blade unit of claim 2 wherein said one or more recesses are in the form of slots.

4. The shaving blade unit of claim 1 wherein said cartridge comprise two or more shaving blade retaining members disposed along a length of the housing.

5. The shaving blade unit of claim 4 wherein said shaving blade retaining members are not placed at the side walls of said housing.

6. The shaving blade unit of claim 1 wherein said shaving blade member has opposing ends and wherein at least of said shaving blade member opposing ends is no more than about 5 mm from said side wall.

7. The shaving blade unit of claim 1 wherein said shaving blade member comprises a bent shaving blade.

8. The shaving blade unit of claim 1 wherein said shaving blade member comprises a shaving blade joined to a blade support.

9. The shaving blade unit of claim 1 wherein said unit is free of clips disposed at said opposing ends of said shaving blade member.

10. The shaving blade unit of claim 1 wherein a cross-sectional shape of said resilient member mates with a cross-sectional shape of said channel to provide a snug configuration.

11. A shaving blade unit comprising a shaving cartridge having a rearwardly secured shaving blade member wherein said cartridge comprises:

a. a housing having a front wall, a rear wall, and opposing side walls extending between said front and rear walls;

b. a bent shaving blade member disposed within said walls of said housing wherein said blade member has a cutting edge that faces a front surface of said housing;

c. a resilient member disposed rearward of said shaving blade member that is secured by a shaving blade retaining member, said shaving blade retaining member being disposed along a width of said housing, said resilient member is recessed within a channel along a length of said retaining member such that a cross-sectional shape of said resilient member mates with a cross-sectional shape of said channel to provide a snug configuration; and wherein said resilient member provides a forward biasing force to said shaving blade member and wherein said shaving blade member exhibits a springing motion during a shaving stroke.

12. The shaving blade unit of claim 11 wherein said retaining member comprises one or more recesses for receiving at least a portion of said shaving blade member.

13. The shaving blade unit of claim 12 wherein said one or more recesses are in the form of slots.

14. The shaving blade unit of claim 11 wherein said cartridge comprise two or more shaving blade retaining members disposed along a length of the housing.

15. The shaving blade unit of claim 14 wherein said shaving blade retaining members are not placed at the side walls of said housing.

16. The shaving blade unit of claim 11 wherein said shaving blade member has opposing ends and wherein at least of said shaving blade member opposing ends is no more than about 5 mm from said side wall.

17. The shaving blade unit of claim 11 wherein said shaving blade member comprises a shaving blade joined to a blade support.

18. The shaving blade unit of claim 11 wherein said unit is free of clips disposed at said opposing ends of said shaving blade member.

* * * * *